US006167687B1

(12) United States Patent
Thompson

(10) Patent No.: US 6,167,687 B1
(45) Date of Patent: Jan. 2, 2001

(54) GROUP TWINNER FOR SINGLE AND DOUBLE CONDUCTOR BOBBINS AND METHOD OF MAKING COMMUNICATION CABLES

(75) Inventor: Walter Thompson, Toronto (CA)

(73) Assignee: Nextrom Ltd., Concord (CA)

( * ) Notice: Under 35 U.S.C. 154(b), the term of this patent shall be extended for 0 days.

(21) Appl. No.: 09/256,931

(22) Filed: Feb. 24, 1999

Related U.S. Application Data

(63) Continuation-in-part of application No. 09/021,929, filed on Feb. 11, 1998.

(51) Int. Cl.[7] ..... D01H 1/10

(52) U.S. Cl. ..... 57/58.49; 57/58.52; 57/58.7; 57/58.72; 57/58.76

(58) Field of Search ..... 57/58.49, 58.52, 57/58.61, 58.72, 58.76, 58.7, 58.83, 58.84, 59, 906

(56) References Cited

U.S. PATENT DOCUMENTS

| | | | | |
|---|---|---|---|---|
| 3,238,711 | * | 3/1966 | Lundgren | 57/58.52 |
| 3,475,892 | * | 11/1969 | Taira et al. | 57/58.61 |
| 4,485,614 | * | 12/1984 | Lindgren | 57/58.52 |
| 5,400,579 | * | 3/1995 | Thompson | 57/59 |
| 5,564,268 | * | 10/1996 | Thompson | 57/58.83 |
| 5,622,039 | * | 4/1997 | Thompson | 57/58.52 |

* cited by examiner

*Primary Examiner*—John J. Calvert
*Assistant Examiner*—Gary L. Welch
(74) *Attorney, Agent, or Firm*—Lackenbach Siegel Marzullo Aronson & Greenspan, P.C.

(57) ABSTRACT

An apparatus is disclosed for manufacturing communication cables with improved, more uniform impedance characteristics at signal frequencies up to and above 600 MHz. The apparatus includes an "inside-out" rigid twisting machine and at least two bobbins supported within each such machine. Each rigid twisting machine includes a drive for spinning each of the bobbins about their respective axes, and fly-off arrangement is provided for flying off an insulated conductor wire wound on each of the bobbins with substantially no tension in the wire when the bobbin attains a first rotational speed. Guides are provided for guiding the wires from each of the bobbins to a closing point where the wires are closed. A double twist bow arrangement is provided which includes second drive for twisting the closed wires at a second rotational speed to form a twinned cable. Controls are provided for adjusting the first and second rotational speeds to apply a pre-twist to each of the wires about their individual neutral axes prior to twinning, after which a take-up is provided for taking up the twin cable. A bank or line of rigid twisting machines are preferably used to produce two or more twinned cables, which all can then be twinned or twisted about each other to form a multi-cable assembly. An alternate embodiment uses a single bobbin wound with a pair of conductor wires that are flown off together and twisted about each other, resulting in a machine with a smaller footprint and bow and higher speeds of operation.

23 Claims, 8 Drawing Sheets

GROUP TWINNER FOR SINGLE AND DOUBLE CONDUCTOR BOBBINS AND METHOD OF MAKING COMMUNICATION CABLES

CROSS-REFERENCE TO RELATED APPLICATION

This application is a continuation-in-part (CIP) of U.S. patent application Ser. No. 09/021,929, filed Feb. 11, 1998.

BACKGROUND OF THE INVENTION

1. Field of the Invention

The invention generally relates to an apparatus and method for the manufacture of telephone and/or communication cables of the type including a single set or a plurality of sets of twisted wires.

2. Description of the Prior Art

Communication cables of the type that include a plurality of twisted wires are manufactured in either one stage or in two stages.

In the case where cables are manufactured in two stages, the twisted wires are first prepared by twisting the wires together by means of so-called twinning or pairing machines. Twisted wires are then made up into communications cables by means of, for example, stationary take-ups, rotating take-ups (also called drum twisting machines) or other types of rotating equipment.

One form of equipment conventionally used for twisting two, three or four wires is the double twist machine. The resulting twisted elements are called pairs, triads or quads.

This equipment includes a bobbin cradle around which is arranged a rotatable frame or bow which is driven to turn around the cradle. Wires to be twisted may be supplied from bobbins on the bobbin cradle inside the twinning cage and taken up on a take-up reel outside the twinning cage. The aforementioned arrangement is referred to as an "inside-out" machine. The wires to be twisted may also be supplied from outside the twisting cage and taken up on a bobbin arranged within the bobbin cradle. The latter configuration is sometimes referred to as an "outside-in" machine.

Outside-in machines are generally preferred in individual twisting machines since the wire may be supplied from storage facilities of simple construction and greater capacity. In this case, the bobbin cradle within the twisting cage is also required to hold only a single bobbin. The outside-in machine is also readily adaptable to use with a greater number of wires.

If communication cables are made in one stage, the apparatus generally employs a plurality of twisting machines, or heads of the "inside-out" type.

The twisted elements so manufactured are directed to any type of take-up (e.g., stationary or rotating take-ups, single or double twist machines, capstan or extrusion lines) for laying up twisted wires to form a communication cable. This is done in one operation.

The plurality of double twist twisting machines can be arranged horizontally or vertically, depending on the preferred plant layout.

One typical example of such an installation is disclosed in U.S. Pat. No. 5,400,579 assigned to the assignee of the subject application.

It is well-known in the art that the lay obtained with double twist actions is not perfectly regular and, if longer lays are used, some irregularity in the position of the cores in the twisted elements have to be accepted in order to achieve higher speed of manufacture. These irregularities in the lays do not cause problems in communication cables such as low frequency telephone cables used in standard telephone applications since the perfect constancy of the lays and in the relative position of the individual wires in each element (pair, triad or quad) are not that critical.

With the advent of high speed data transmission, especially for computer use and other applications, the frequencies required are much higher and therefore standard pairs, triads or quads acceptable in telephone networks cannot be used in such high frequency applications.

It is well known, for example, that the characteristic impedance of an n-wire cable is a function not only of the diameters of the individual conductors but also a function of the spacing or distances between the conductors. Matched impedances are critical at high frequencies to optimize power transfer, reduce line reflections which cause deterioration of signal integrity and optimize the useful frequency band width for which the cable can be used.

It has been proven that, for example, the characteristic impedance of pairs can change drastically at different frequencies around its theoretical average. Cables utilizing high quality pairs have been produced for use in communication local area networks (LANs) with a maximum useful frequency of 100 MHz. This, in the industry, is called a Level or Category 5 cable. The specification for these cables requires, for example, that the nominal characteristic impedance of 100 Ohms can only vary between 85 and 115 Ohms from 0 to 100 MHz.

The industry is already requiring twisted elements, especially pairs, that will maintain their electrical characteristics up to and above 600 MHz. This is normally called an "enhanced" Category 5 or Category 6 communication cable.

In order to produce pairs, triads or quads that can operate satisfactorily at these frequencies, it is necessary to produce a cable in which the individual elements or wires of each pair, triad or quad ideally be maintained substantially in the same desired positions relative to each other so that the electrical characteristics of the pair, triad or quad vary within specified ranges along the length of the cable.

One acceptable way of achieving this has been to shorten the lays of the elements in order to manufacture an element that is mechanically more stable. This approach has, however, reduced the productivity of the equipment since there are physical limitations on the rotational speeds of the bows used in double twist machines.

Another approach for maintaining the mechanical integrity of assembled cable is disclosed in U.S. Pat. No. 5,622,039, assigned to the assignee of the subject application, which uses a group twinner in which each wire twister includes an internal tape dispenser for taping the wire pairs before assembly of the cable.

A still further approach is disclosed in U.S. Pat. No. 5,606,151 for a twisted parallel cable intended for high frequency transmission use that includes a plurality of insulated conductors that are twisted to form a pair. The pairs of adjoining insulated conductors are encased within a thermoplastic, fluorocopolymer or rubber type material.

However, "physically" maintaining the relative positions of the individual wires along the length of the cable is not sufficient as the frequency of operation is pushed higher and higher, where factors not visible at lower frequencies become important considerations. Because impedance is a unction of the spacing between the conductors, variations in the eccentricities of the conductors within their insulating sheaths also impact on the spacings between the conductors. In most cases, the conductors are never precisely concentric in relation to their exterior insulations, most conductors being within the range of 88% to 95% concentricity. This means, however, that there is more insulation on one side of a conductor than on the other, thus creating physical bumps or high spots, on one side, and low points, on the other. Because two forces are created when two wires are twisted, one that twists the wires and the other that is directed toward the center, a twisted pair will typically arrange the individual wires to be in abutment at the thinnest portions of the insulation. These regions of reduced interconductor spacing create corresponding regions of lower impedance. As suggested, at lower frequencies such low spots caused by variations in eccentricity are not consequential. However, as the wavelength of the signal frequencies approach the distances between such low spots this problem becomes more significant. As data transfer is pushed from 100 megabits/sec. to 600 megabits/sec any deviations that effect the electrical properties of the twisted conductors are as significant as the factors that maintain the mechanical integrity of the cable.

It has been observed that by torsioning the individual wires about their own neutral axes prior to twinning the high and low spots on the twinned wires are made to shift along the cable, this having the effect of averaging or smoothing out impedance variations and having beneficial results on the overall cable, reducing structural return losses (SRLs) as well as the impedance fluctuations over the anticipated frequency ranges. See, for example, FIGS. 1 and 2 which show the impedance and SRL characteristics of a cable made with a planetary machine, which provides full or 100% backtwist on the individual wires prior to twinning, and FIGS. 3 and 4, showing the impedance and SRL characteristics of a cable made on a rigid machine with a zero backtwist. These differences can best be explained by referenced to FIGS. 5 and 6.

In FIG. 5 a pair of insulated wires 10, 12 are shown in abutment or in contact with each other at a point or, more accurately, a helical line 14. For purposes of simplicity the conductor 10*a* of the wire 10 is shown to be perfectly concentric within the insulating sheath 10*b* (concentricity=100% or eccentricity=0). The conductor 12*a* of the wire 12, however, is eccentric in relation to the insulator 12*b*, the extent of eccentricity being defined as $e=(t_1/t_2 100)\%$. As a result, the interconductor spacing S is less than the diameter of the wires, as it would be if both conductors were perfectly concentric. The wire 10 is labeled with a triangular marker 10*c* while the wire 12 is labeled with a dot marker 12*c* for establishing reference points of angular orientation of these wires about their own axes. The wire pair P in FIG. 6*a* develops a helix having a length l which is a function $D_0$ equal to the diameter described by the processed members, the amount of torsion being a function of the nature of the machine performing the twinning. For a rigid frame machine the torsion is:

$$\text{Torsion}=360°L/[(\pi D_0)^2+L^2]^{1/2} \quad (1)$$

For a planetary machine the torsion is:

$$\text{Torsion}=360°L/[(\pi D_0)^2+L^2]^{1/2}-360°. \quad (2)$$

It is evident from equations 1 and 2 that for very small diameter wires the torsion for a rigid-frame machine is about 360° over one lay length (FIG. 6*c), while that torsion is about* 0° for a planetary machine (FIG. 6*d*). In FIGS. 6*c* and 6*d*, each of the wires are illustrated at 0°, 90°, 180°, 270° and 360° intervals or positions along the helical twist, showing both how the individual wires have been torsioned about their axes and about themselves. With the rigid machine, the wires in FIG. 6*c* rotate equally about each other as well as about their individual axes so that the wires continue to contact along the same line 14. However, in FIG. 6*d*, for the planetary machine, the wires twist about themselves although they maintain their individual angular orientations fixed throughout the helix. For this reason the markers 10*c*, 12*c* remain fixed at the 12:00 o'clock positions along the helix while they are twisted about each other when made on a planetary machine.

From FIGS. 1 and 2 it is clear that the torsioning or rotating of the wires 10, 12 about their individual axes with a planetary machine (FIG. 1) improves the impedance characteristics of the twisted pair, reducing the impedance variation to approximately 10 Ohms over the frequency range of 0–100 Mhz, while the wires formed by a rigid machine (FIG. 3) provide much greater swings and exceeds UL specifications at a number of frequencies by dropping below 85 Ohms or exceeding 115 Ohms. While this suggests that high frequency pairs for Category 5 and 6 cables should be made on planetary machines, such machines are not the machines of choice for these applications, and rigid machines are used almost exclusively because of their better productivity for stranding, pairing, etc. However, rigid machines that pre-twist the individual wires prior to twinning, etc., have not been used with group twinners to efficiently produce high frequency cables that have enhanced high frequency products.

SUMMARY OF THE INVENTION

It is an object of the present invention to provide an apparatus for making communication cables which does not have the disadvantages and limitations inherent in comparable prior art machines.

It is another object of the present invention to provide an apparatus of the type aforementioned which is simple in construction and inexpensive to manufacture.

It is still another object of the present invention to provide an apparatus to manufacture communication cable that can operate at significantly higher linear speeds than comparable machines currently being used for making the same communication cable product.

It is yet another object of the present invention to provide an apparatus for making telephone cables that makes it possible to produce pairs, triads or quads with the group twinners as disclosed in U.S. Pat. No. 5,622,039.

It is a further object to provide an apparatus as suggested in the previous objects with a rigid machine for applying a pre-twist to the individual wires about their own axes prior to twinning.

It is still a further object to provide an apparatus as in the previous object that provides a backtwist to the individual wires prior to twinning to compensate for any conductor eccentricities that exist within their insulating sheaths to average out impedance discontinuities.

It is yet a further object to provide a communication cable in which any impedance discontinuities resulting from conductor eccentricities are averaged and minimized by a continual angular or rotational shifting of the individual wires about their own neutral axes as the wires are twinned about each other.

It is an additional object of the invention to provide a method for efficient production of communication cables by continually angularly and rotationally shifting the individual wires about their own neutral axis as the wires are twinned about each other and by group twinning the twinned pairs prior to take-up.

It is still an additional object to provide an apparatus and method in accordance with the invention which minimizes the size of the bow to minimize the footprint of the apparatus and maximize the twinning speed.

It is yet an additional object as in the previous object to achieve the desired results by using a single bobbin wound with wire pairs so that two wires can be simultaneously removed from a single bobbin and twinned.

In order to achieve the above objects, and others which will become apparent hereafter, the apparatus for manufacturing communication cables in accordance with the present invention comprises at least "inside-out" rigid twist machine. Support means is provided for rotatably supporting at least one bobbin wound with a total of at least two insulated conductor wires, within each of said at least one twisting machine, to substantially fix the positions and orientations of said at least one bobbin. Each of said at least one rigid twisting machines includes first drive means for spinning each of said at least one bobbin about its respective axis. Fly off means is provided for flying off at least one insulated conductor wire wound on said at least one bobbin with substantially no tension in the wires when said at least one bobbin attains a first rotational speed. Guide means is provided for guiding said at least two conductor wires from said at least one bobbin to a closing point. Closing means is provided for closing said at least two wires. Twisting means includes second drive means for twisting the closed wires at a second rotational speed about each other. Control means is provided for adjusting said first and second rotational speeds and for imparting a twist rate to said at least two conductor wires which is a function of the composite of said first and second rotational speeds. Take up means is provided for taking up the twinned cable. Depending on the relative twist rates and directions of the first and second drive means the apparatus can be used either to provide a back twist to selected conductor wires or to enhance twist rates and thereby increase production output.

The invention also includes a method of manufacturing cables, comprising the steps of supporting at least one bobbin wound with a total of at least two insulated conductor wires, within each of at least one rigid twisting machine. Said at least one bobbin is caused to spin about its respective axis. Said at least two insulated conductor wires wound on said at least one bobbin are made to fly off with substantially no tension in the wires once said at least one bobbin attains a first rotational speed of rotation. The wires are then guided from said at least one bobbin to a closing point and the wires are closed at that point. The closed wires are then twisted at a second rotational speed to form a twinned cable, said first and second rotational speeds being adjusted to impart a twist rate to said conductor wires which is a function of the composite of said first and second rotational speeds and relative twist directions. The twisted cable is then taken up downstream of said at least one rigid twisting machine.

In order to achieve the above objects, and others which will become apparent hereafter, an apparatus for manufacturing communication cables with improved, more uniform impedance characteristics at signal frequencies up to and above 600 MHz comprises at least one "inside-out" rigid twisting machine; at least one bobbin, wound with a pair of insulated conductors, supported within each of said at least one twisting machines. Each rigid twisting machine includes a first drive means for spinning each of said at least one bobbin about their respective axes and fly-off means for flying off a pair of insulated conductor wires wound on said at least one bobbin with substantially no tension on the wires when said at least one bobbin attains a first rotational speed of rotation. The rigid twisting machine also includes guide means for guiding the wires from at least one said bobbin to a closing point and closing means for closing the wires. The rigid twisting machine also includes twisting means including second drive means for twisting the closed wires at a second rotational speed to form a twinned cable. Control means is provided for adjusting said first and second rotational speeds to twist each of the wires about each other and about their individual neutral axes prior to twinning. Take-up means is providing for taking up the twinned cable. In accordance with one presently preferred embodiment one bobbin is supported within each twisting machine to produce a twinned pair.

A plurality of like twisting machines may be arranged in a bank or line of machines each for forming a twin cable, and a further twisting means is provided for assembling the twin cables into a multi-cable assembly.

The invention also includes the method of manufacturing cables with improved, more uniform impedance characteristics as aforementioned including the steps of supporting at least two bobbins within each of at least two rigid twisting machines and spinning each of the bobbins about their respective axes. The method includes flying off an insulated conductor wire wound on each bobbin off the bobbin with substantially no tension in the wire when the bobbin attains the first rotational speed of rotation. The wires from each of the bobbins are guided to a closing point where the wires are closed. The closed wires are twisted at a second rotational speed to form a twinned cable. The first and second rotational speeds are adjusted to apply a pre-twist to each of the wires about their individual neutral axes prior to twinning. The twinned cable is taken up downstream of the rigid twisting machine. In the presently preferred embodiment the step of pre-twisting comprises the step of providing a backtwist within a possible range of 5%–100%, with a presently preferred range of 10%–40%. The invention also contemplates a twinned cable made in accordance with the method.

BRIEF DESCRIPTION OF THE DRAWINGS

Other aspects, objects and advantages of the present invention will become apparent upon reading of the following detailed description of the preferred embodiment of the present invention when taken in conjunction with the drawings, as follows.

DESCRIPTION OF THE PREFERRED EMBODIMENTS

Figure 2:
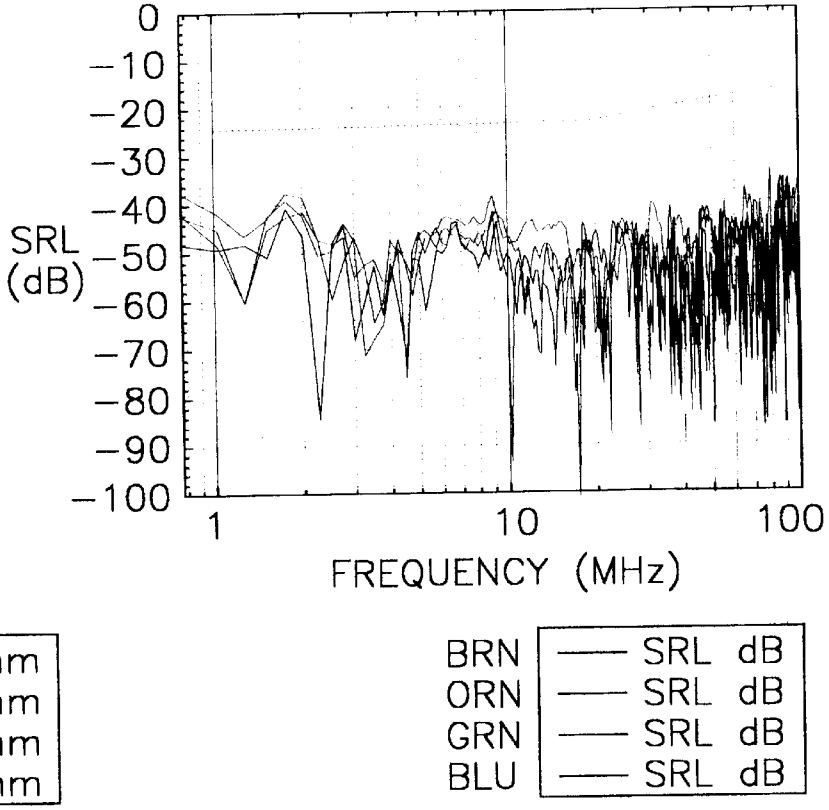
FIG. 2 is a graph illustrating the structural return loss (SRL) for a cable made on a planetary machine, over a frequency range substantially corresponding to that of FIG. 1.
Figure 1:
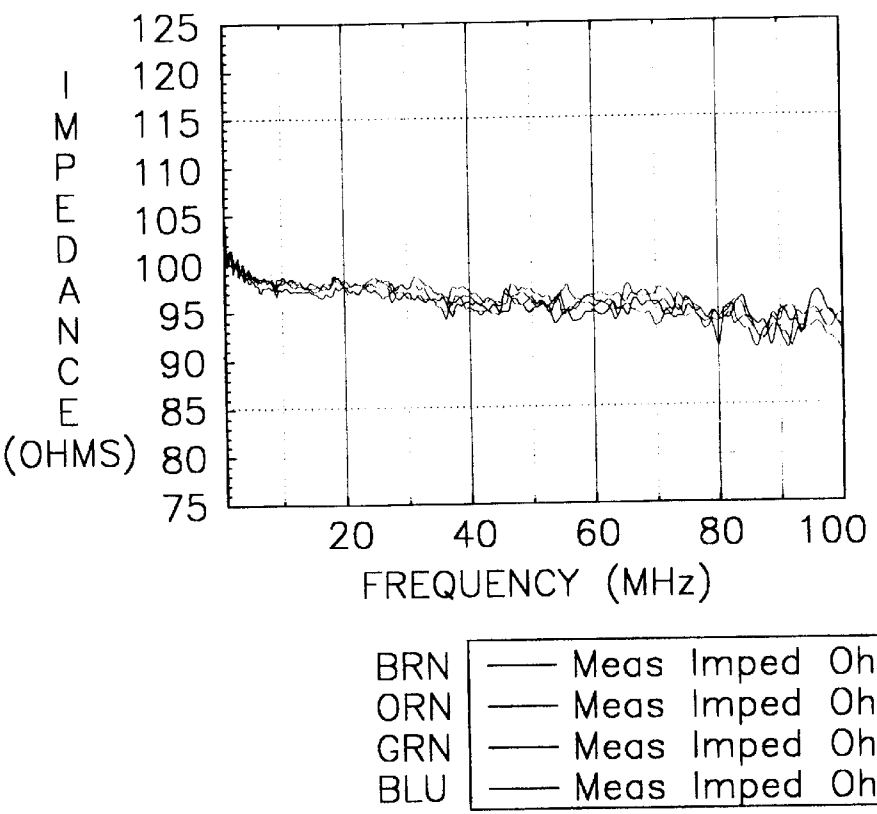
FIG. 1 is a graph of the impedance characteristics of a twinned cable within the frequency range of 0–100 MHz for a cable made on a planetary machine.
Figure 4:
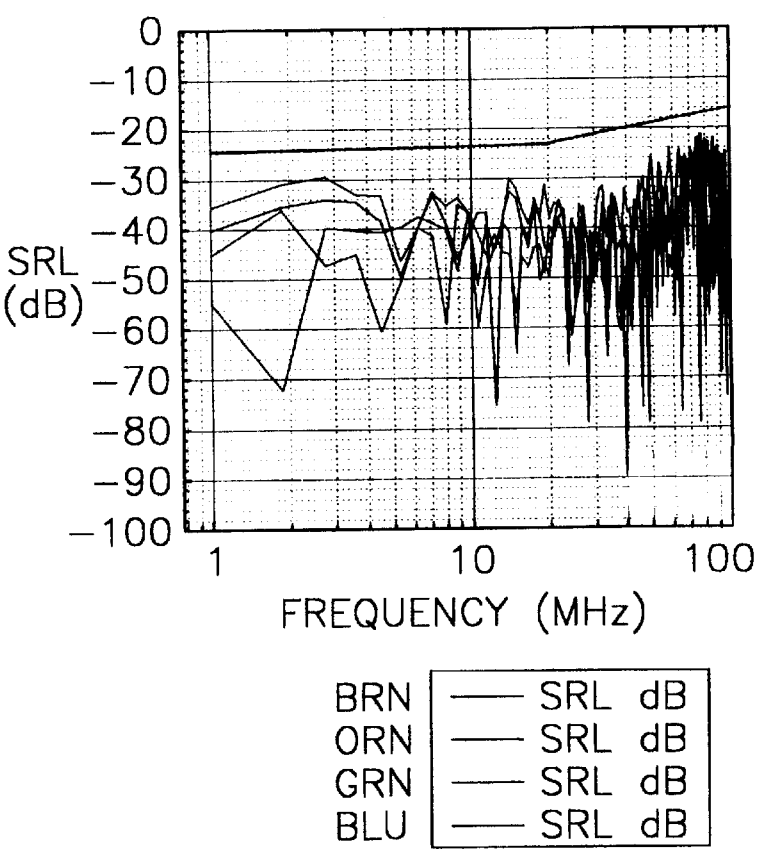
FIG. 4 is similar to FIG. 2, but showing the SRL for the cable made on a rigid machine.
Figure 3:
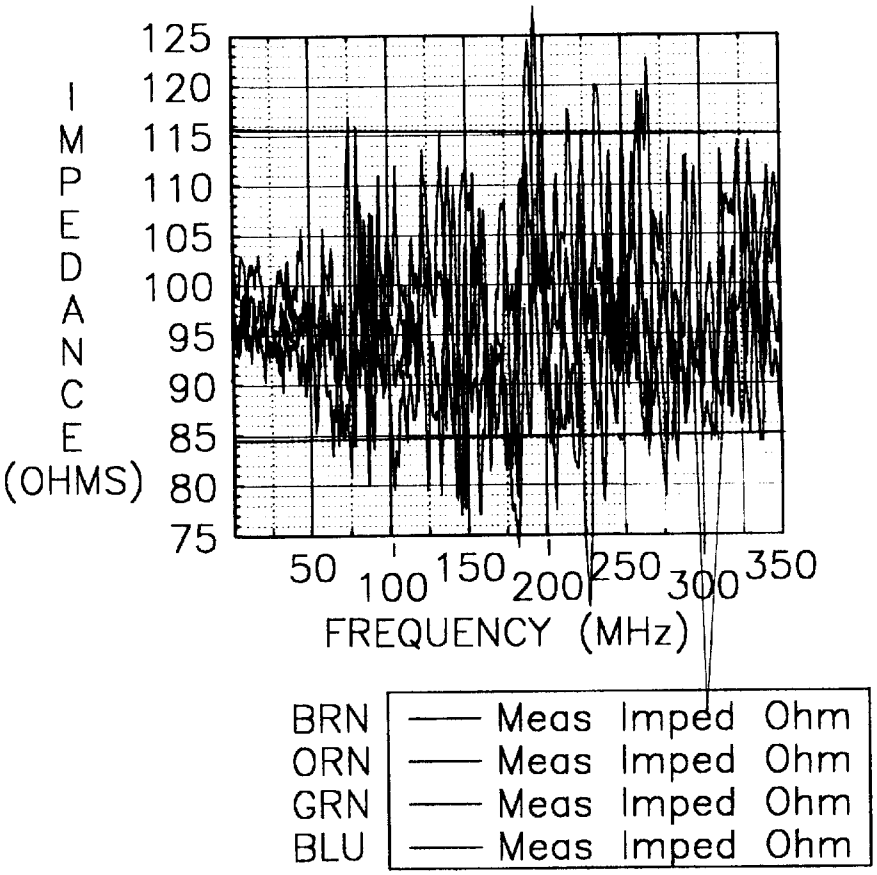
FIG. 3 is similar to FIG. 1 but illustrating the impedance fluctuations for a twinned cable made on a rigid machine.
Figure 5:
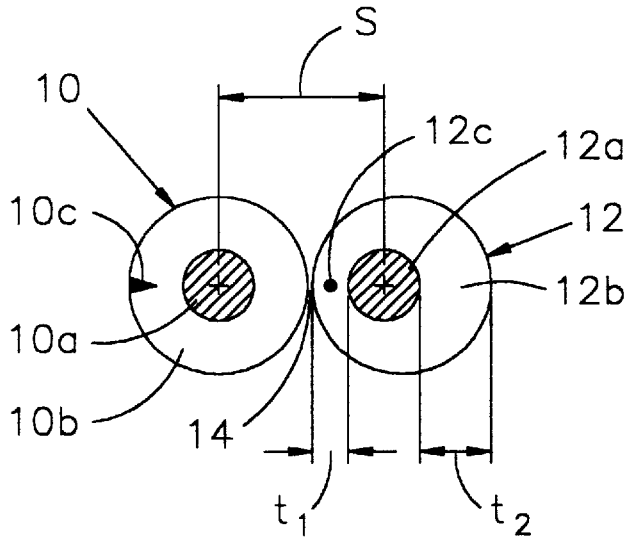
FIG. 5 is a pictorial representation of two conductors each covered by an insulating layer which are in contact with each other, viewed in cross section, illustrating one of the conductors to be substantially concentric within its associated insulator, while the other conductor is offset or eccentric within its associated insulator.
Figure 6:
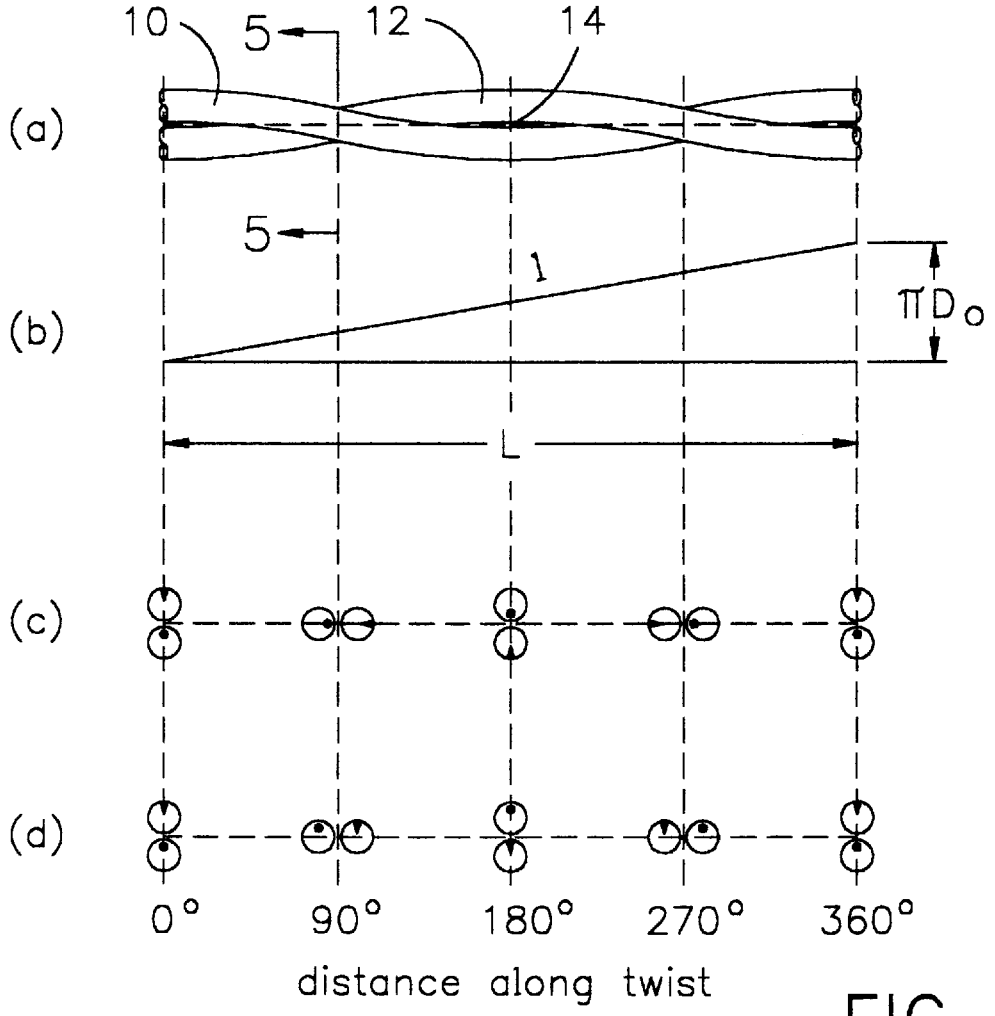
FIG. 6*a* is a side elevational view of a pair of twinned conductors of the type shown in FIG. 5 over a length of one lay of twist.
FIG. 6*b* illustrates the length of the individual conductors in the helix resulting from the twinning of the conductors, as a function of the diameter described by the individual wires.
FIG. 6*c* is a series of schematic cross sectional representations of the wires shown in FIG. 5, taken along 90° intervals over the lay of the twinned conductors, illustrating the relative positions of the individual wires about their own neutral axes as a result of torsioning of the wires about their own axes and relative to each other as a result of twinning on a rigid machine.
FIG. 6*d* is a series of schematic cross sectional representations of the wires shown in FIG. 5, taken along 90° intervals over the lay of the twin conductors, illustrating the relative positions of the individual wires about their own neutral axes as a result of torsioning of the wires about their own axes and relative to each other as a result of twinning on a planetary machine.
Figure 7:
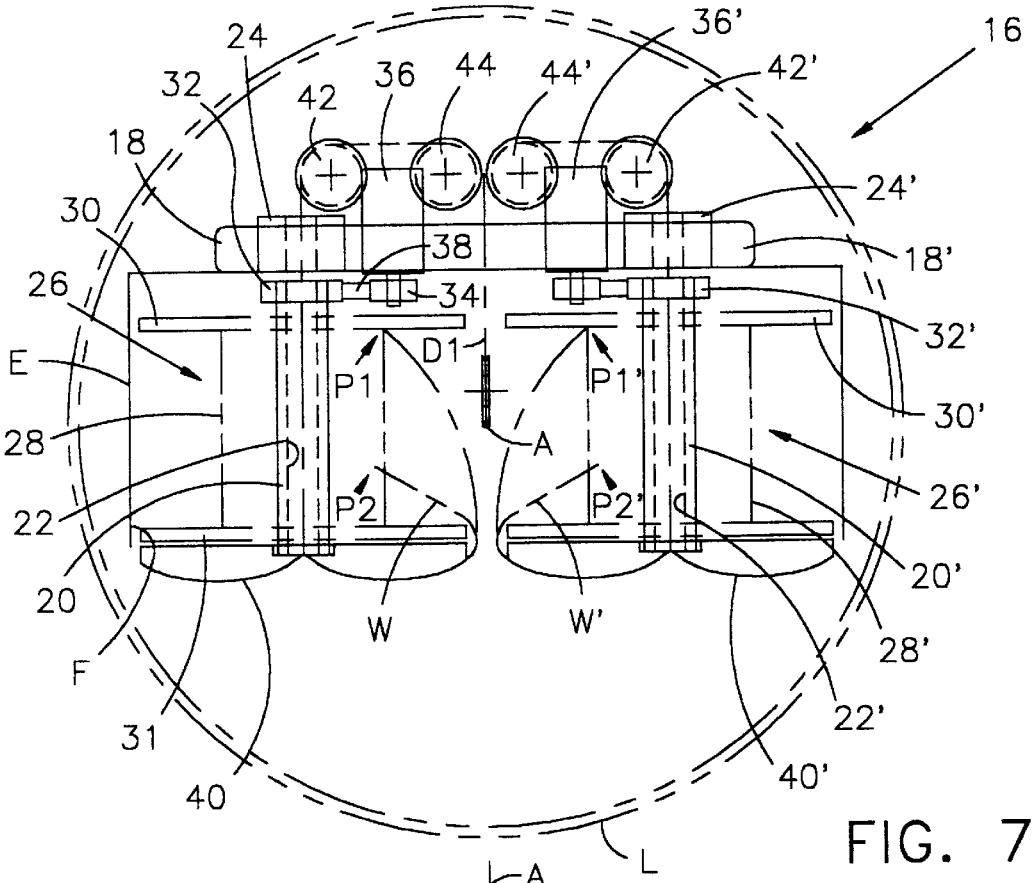
FIG. 7 is a top plan view of an apparatus for manufacturing communication cables in accordance with the present invention, illustrating the manner in which the insulated wires fly off two different positions on the drums of two rotating bobbins, and showing, in phantom outline, the envelope defined by rotating bows that twist the wires after they have been removed from the bobbins.
Figure 8:
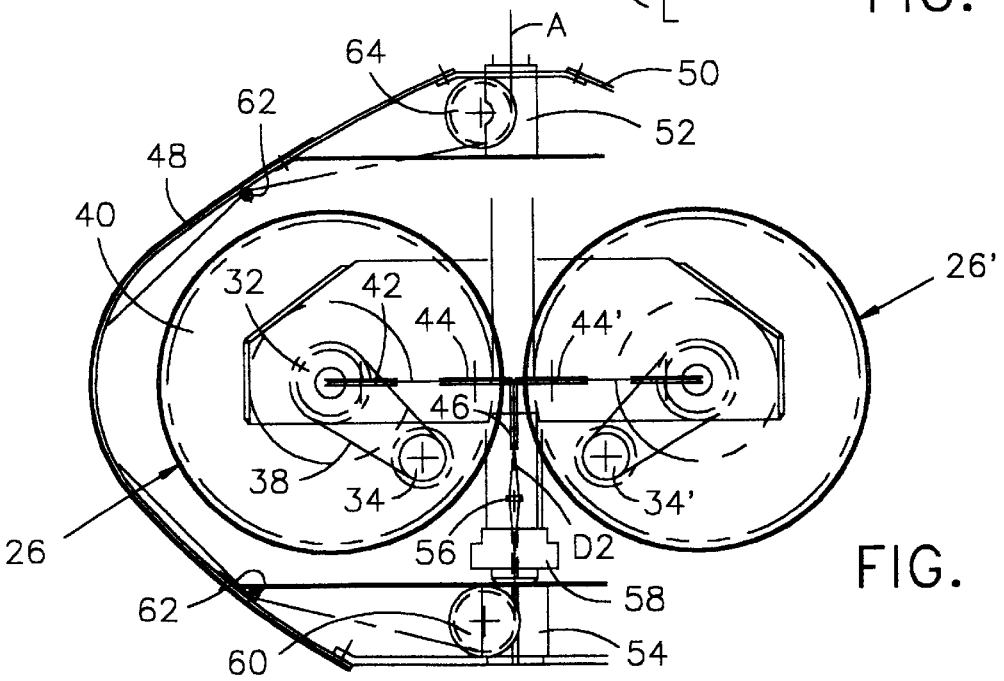
FIG. 8 is a front elevational view of the twinner illustrated in FIG. 7, shown partially broken away, and showing the drives for rotating the bobbins and the guide pulleys for guiding the wires from the bobbins to the rotating bow for twinning.

Referring now specifically to the drawings, in which identical or similar parts are designated by the same reference numerals throughout, and first referring to FIGS. 1–6, discussed in the Background of the Invention, the present invention has as its primary objective to provide an apparatus and method for torsioning or twisting individual insulated wires about their neutral axes prior to twinning, as occurs with planetary machines, but to do so with rigid machines which are mechanically more stable and have a much higher capacity for productivity The invention will initially be described in connection with FIGS. 7 and 8, which illustrate one embodiment of the invention. The machine is a two bobbin rigid twinner of the "inside-out" type and is generally designated by the reference numeral 16. The twinner 16 is configured to supply two insulated conductors of the type 10, 12 illustrated in FIG. 5. The unprimed reference numerals on the left side of FIG. 7 designate components associated with one of those wires and the "primed" reference numerals on the right side designate the same components for the other wire. Only the components on the left side will be described, it being understood that the corresponding components on the right side perform the same functions for the other wire.

The twinner 16 includes a pair of generally stationary cradles 18, 18', each of which supports a hollow shaft 20 provided with an elongate through channel 22 and mounted for rotation on the cradle 18 by means of bearing 24.

Mounted on the rotatable shaft 20 is a conventional bobbin or reel 26 that includes a drum 28, on which wire is wound, and axial flanges 30, 31.

Referring to FIGS. 7 and 8, the shaft 20 is coupled to a pulley 32 that is driven by a pulley 34 on the shaft of a motor 36 by means of a belt 38.

When the bobbin 26 rotates at a sufficiently high speed it will be evident that the wire wound on the drum 28 will attempt to fly off radially outwardly due to centrifugal forces. The wire W on the bobbin 26 is shown leaving the drum 28 at two positions P1 and P2, P1 from the rearmost position on the drum, and an intermediate position P2. When the wire flies off the bobbin it is drawn or pulled over the forwardmost flange 31. To minimize friction between the wire W and the perimeter of the flange and, therefore, to reduce tension in the wire, suitable means are provided for presenting a smooth surface for the wire as it flies over the flange 31. In the embodiment of FIGS. 7 and 8, a cone 40 is provided which may be made of nylon or ceramic to present a smooth low friction surface for guiding the wire beyond the flange 31 and into the channel 22. Such cones promote a minimum of friction and more uniform, low tension in the wire.

Referring to FIG. 7, each bobbin is at least partially enclosed by a coaxial enclosure E provided with a friction inducing surface F facing the associated bobbin. It will be evident that when the wire loop assumes the size as shown during fly off, the wire may pass between the space formed by the flange 31 and the enclosure E. However, when the size of the loop increases beyond that point, it contacts the friction inducing surface F, thus increasing the tension in the wire, this having the effect of decreasing the size of the loop. The enclosure E and its internal friction inducing surface F, therefore, serve as a feedback mechanism for retaining the size of the loop during fly off at a desired level.

The wire W is guided beyond the flange 31 and the flier disc 40 through the channel 22 and by deflecting pulleys 42, 44 along generally horizontal direction D1. It will be noted that corresponding pulleys likewise direct the wire W' along direction D1 so that both wires W, W' are substantially coextensive and can together be redirected by pulley 46 in general vertical direction D2 (FIG. 8).

As best shown in FIG. 8, a bow 48 is provided for guiding the wires W, W' from the bottom of the machine into the top of the machine. A counterweight bow 50 is used to equalize or balance the weight about the bow axis of rotation A to permit the rotating bow to achieve higher speeds. The bows 48, 50 are rotatably mounted on a bearing housing 52 at the top and a bearing housing 54 at the bottom, so that the bow 48 defines an envelope or space the outer periphery of which is shown in dash outline L in FIG. 7. Being an "inside-out" machine the supply of bobbins 26, 26' is arranged within the envelope or space defined by the rotating bows.

Still referring to FIG. 8, a lay plate 56 is provided downstream from the pulley 46 through which the wires W, W' pass, after which the wires are directed through a closing die 58. Downstream of the closing die 58 is the first twisting pulley 60 associated with the bow 48 which guides the wire pair W, W' along the bow by means of eyelets or loops 62 to the upper end of the bow where there is provided a second twisting pulley 64. As is well known, the bow 48 imparts a first twist at the pulley 60 and a second twist at the pulley 64 before the twinned pair is directed upwardly along the axis A.

Figure 9:
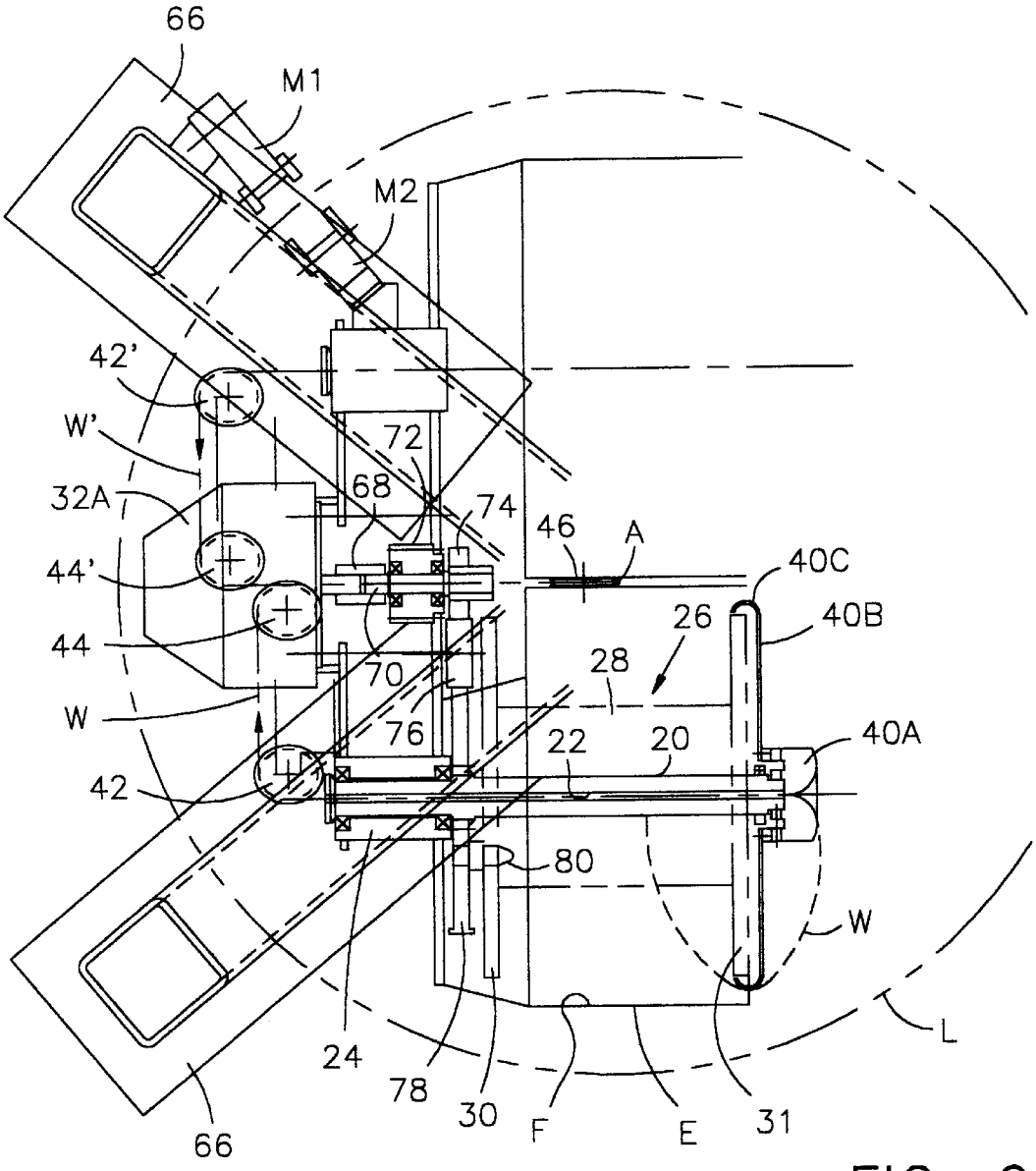
FIG. 9 is similar to FIG. 7, only showing details of one bobbin, and illustrating additional mounting details and an alternate drive for rotating the bobbins.
Figure 10:
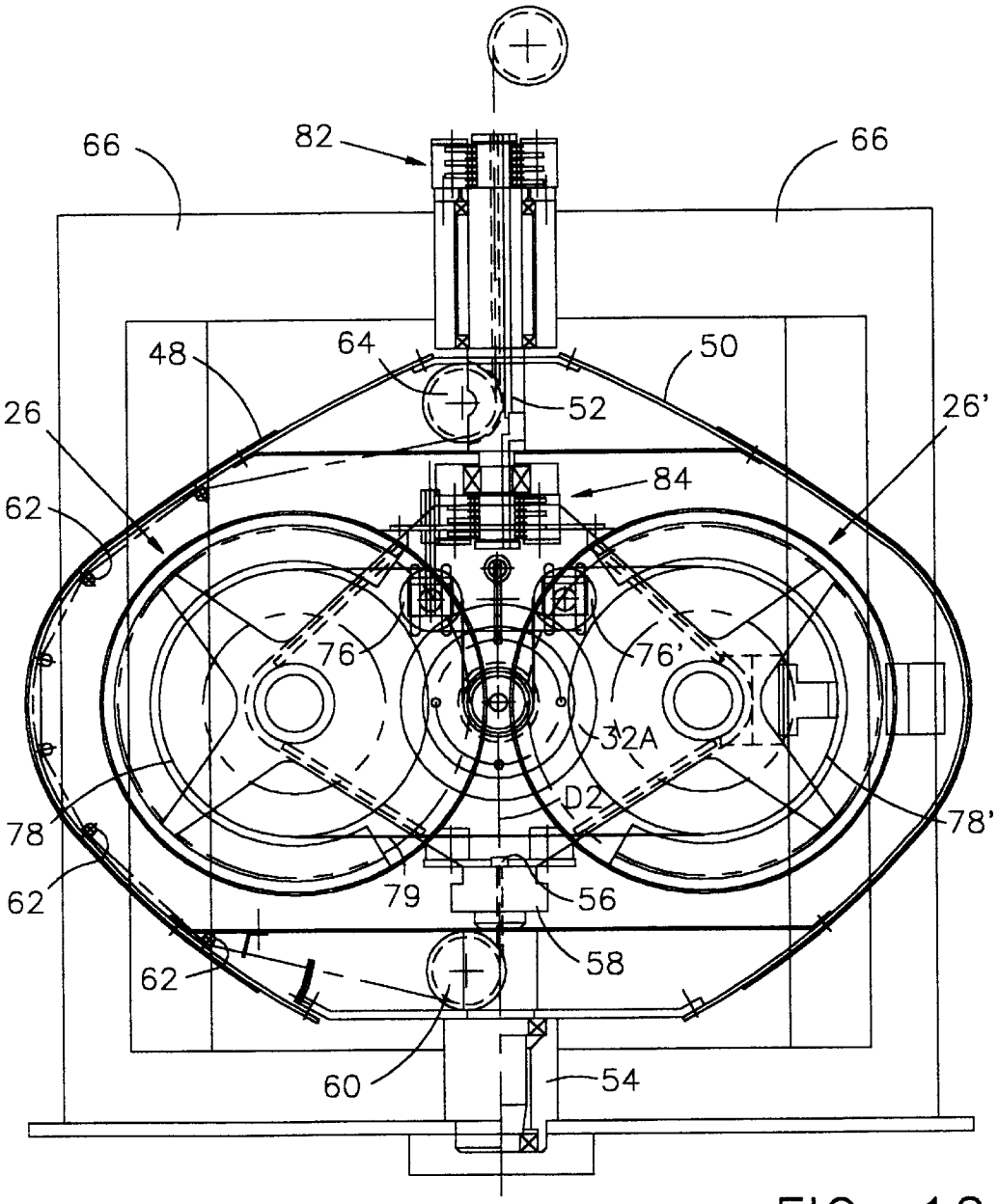
FIG. 10 is a front elevational view similar to FIG. 8, but showing the embodiment of FIG. 9.
Figure 11:
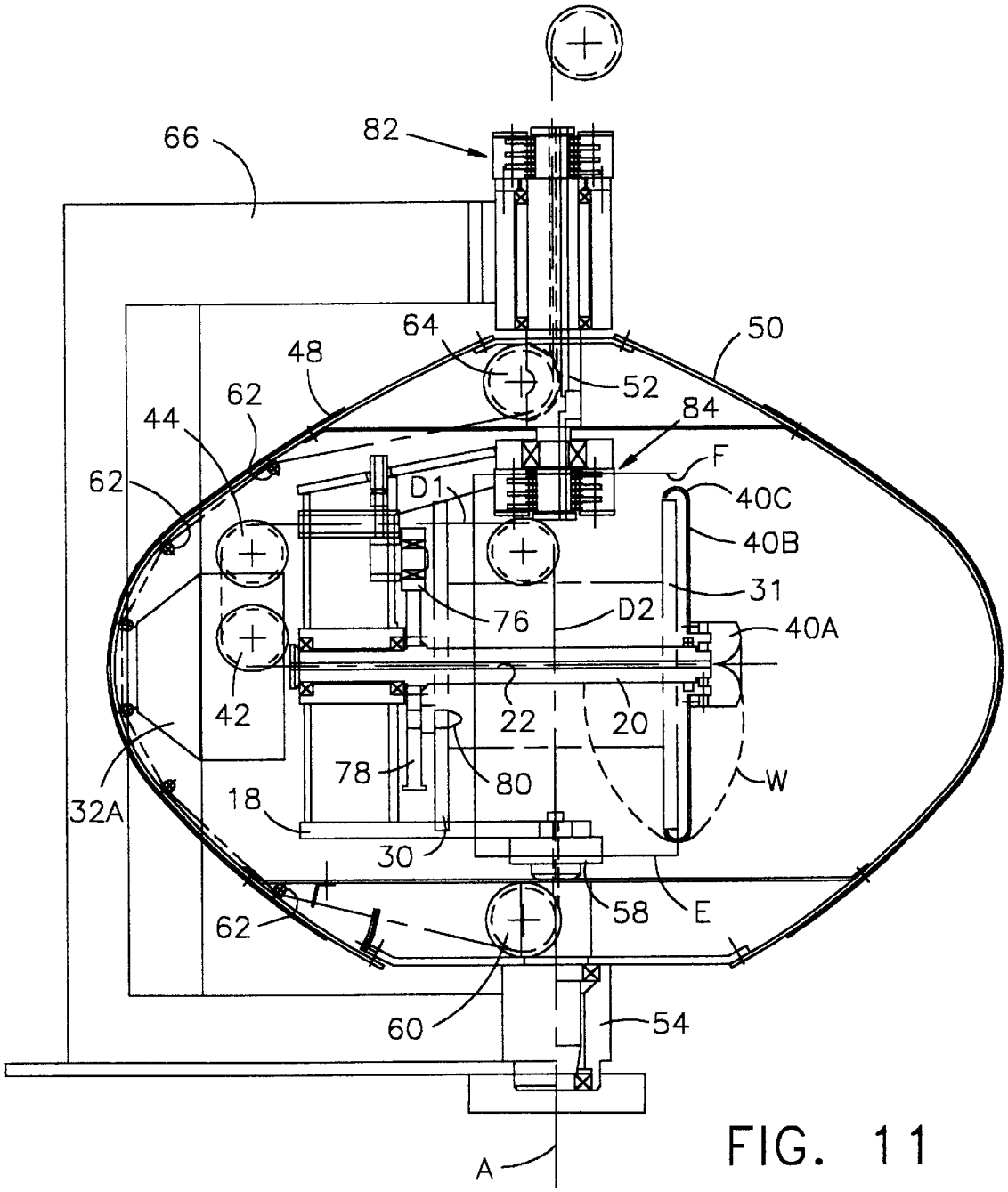
FIG. 11 is a side elevational view of the twinning machine illustrated in FIGS. 9 and 10.

Referring to FIGS. 9–11, another embodiment of the invention is shown which is very similar to the first embodiment. Here the frame 66 is shown, as well as some additional details. In this embodiment, a single motor 32A has a shaft that is attached, by means of a coupler 68, to a shaft 70 rotatably mounted within a bearing housing 72. The shaft 70 is connected to a drive pulley 74 which drives individual bobbin pulleys 76, 76' (FIG. 10) by means of a belt 79 which extends about the aforementioned pulleys 74, 76, 76', as well as drive pulleys 78, 78' coupled to the bobbins in any suitable or conventional manner. In the embodiment shown, such coupling is by means of a pin 80 which projects from the drive pulley 78 into an opening within the flange 30.

As best shown in FIGS. 10 and 11, slip ring assemblies 82 and 84 are provided for providing electrical power to the motor 32A through the rotating bow system.

Referring to FIG. 9, a magnet M1 is fixed on the support frame 66 while a magnet M2 is attached to the stationary cradle. It will be noted that the phantom circle outline extends between the magnets M1, M2, indicating that the rotating bow passes between the magnets. However, because of the strong magnetic forces of attraction, the two magnets to stabilize the cradle and prevent it from rotating about its bearing notwithstanding the rotation of the bow.

As suggested, the Underwriter Laboratory's (UL's) LAN Cable certifications specify that Category 5 cables must remain within the range of 85–115 Ohms over the frequency range up to 100 MHz. Since the wires W, W' invariably exhibit eccentricities, typically exhibiting only 88% 95% concentricity, the present invention has as its objective to utilize a rigid twinning machine that imparts a backtwist in order to enhance the twinned cable characteristics. This is done by torsioning or rotating the individual wires about their neutral axes prior to twinning. For example, with a bow speed of 1500 rpm, which translates to 3000 twists per minute (each turn of the bow imparting two twists to the wires), if the bobbins are rotated at 30% of the twist rate (twist per minute) this translates into bobbin rotation speed of 900 rpm. This results in a backtwist that provides improved electrical characteristics notwithstanding slight imperfections or deviations in the eccentricities of the individual wires. It should be noted, however, that 30% backtwist is not a critical parameter and different percentages of backtwist may be used. In fact, the range of pre-twisting may be from 5%–100% backtwist, although the presently preferred range is 5%–40%. If the backtwist is reduced below 5% the effect or benefit of the invention will be totally or partially lost.

With the wires initially pretwisted, the twinned wires leave the double twist machine and may be directed to a take-up, as disclosed in U.S. Pat. No. 5,622,039. In the presently preferred application of the invention two or more rigid-type double twist machines of the type designated by the reference numeral 16 are provided in a line or bank of such machines, the twinned pairs emanating from each of the machines being directed along a common direction substantially coextensively to each other for a further twisting step for providing a twinned multi-cable assembly.

The method of manufacturing cables in accordance with the present invention, in order to provide an improved, more uniform impedance cable at signal frequencies up to and above 600 MHz, includes the steps of supporting at least two bobbins 26, 26' within at least one rigid twisting machine 16. Although only one such machine is shown in the drawings, it is clear that a line or bank of such machines may be arranged as disclosed in U.S. Pat. No. 5,622,039, which is incorporated by reference herein. The bobbins are caused to spin about their respective axes in order to fly off an insulated conductor wire wound on each of the bobbins with substantially no tension in the wire when the bobbin attains a first rotational speed of rotation. Subsequently, the wires are guided from each of the respective bobbins to a closing point for closing the wires. The closed wires are then twisted at a second rotational speed by the bow 48 to form a twinned cable, a twinned pair in the illustrated embodiment. It should be evident, however, that three bobbins, four bobbins, etc., may be used in larger twinning machines in order to twin different numbers of wires about each other. A separate supply bobbin needs to be provided for each additional wire desired in the twinned cable. The first and second rotational speeds of the bobbins, on the one hand, and the bow, on the other hand, are adjusted to provide a pre-twist to each of the wires W, W' about their individual neutral axes prior to twinning. As suggested, pretwisting need not entail backtwisting but may entail forward twisting. By departing from the traditional rigid machine operation the individual wires are torsioned or rotate about their axes. The extent to which this occurs will be a function of the degree or level of pre-twisting. The relative "shifting" of the markers 10*c*, 12*c*, at presently preferred levels of pre-twisting, will fall somewhere between the positions shown in FIGS. 6*c* and 6*d* for the rigid and planetary machines. Such torsioning of the wires, as they twist about each other, averages imperfections or spots of higher or lower impedance due to eccentricities in the conductors in their insulating sheaths and, in effect, at least partially compensates or offsets these variations.

However, instead of the wire turning on itself, the two wires twist together.

While the embodiments illustrated in FIGS. 7–11 are useful to provide a pre-twist to the conductors forming the twin cables, with attendant improved impedance and electrical characteristics at high frequencies, the same machines can, in some cases and with minor structural modifications, be used to increase the productivity by increasing the total twist rates for a given configuration. Thus, referring to FIGS. 12 and 13, an alternate embodiment is shown, generally designated by the reference numeral 90, which is structurally related to the previous embodiments and intended to optimize twisting rates and output productivity.

The twinner 90 differs primarily from the previous embodiments in that only a single bobbin 16 is shown which is supported by the cradle 18. The bobbin 26, as in the previous embodiments, is likewise rotatably mounted and driven by the drive motor 34. In this arrangement, the bobbin 26 is initially pre-wound with a pair of insulated conductor wires 2W. Both wires are simultaneously flown off and removed, as previously described, and guided to cone 40, to guide rollers 96, 98 and 100, and to the twisting pulleys 60, 64 of the bow 50, thereby imparting the desired twists to the wire pair. Since only a single bobbin is wound with a pair of conductors, the cradle 18, the bow and the footprint of the machine may be reduced. By reducing the size of the bow, the speed of operation of the bow can be increased, thereby increasing manufacturing efficiency. In this connection, it is noted that the volume of a bobbin generally increases as the square of the radius, for a given axial length. It should be clear, therefore, that approximately the same amount of wire can be wound on two bobbins of a given radius as can be wound on a single bobbin whose radius is increased less than 1½ times the radius of the two smaller bobbins. Therefore, while the twinner 90 needs a slightly larger bobbin pre-wound with a pair of wires, this other arrangement avoids the use of a second bobbin, a second cradle and the other accessory components such as bearings and the like. This reduces the overall size of the machine and increases its speed. By regulating the speeds of the drive motors that drive the bobbin and the bow and, therefore, the relative speeds of rotation of the bobbin and the bow, emphasis can be placed on creating the backtwist, aforementioned, or imparting additional twists to increase the overall twist rates of the twisted conductors. Thus, if 400 twists are imparted by flying off the wires from the cradle 26 and the bow 50 rotates at 2000 rpm, 4000 twists are imparted due to the action of the bow and its two associated twisting pulleys, for a total of 4400 twists, when the twists are in the same direction, by appropriate pre-winding of the bobbin and unwinding of the bobbin in the same direction of rotation as the bow. While elimination of the back twist may cause some deterioration of the electrical properties of the twisted wires, productivity is increased because of the higher total twist rates.

Figure 13:
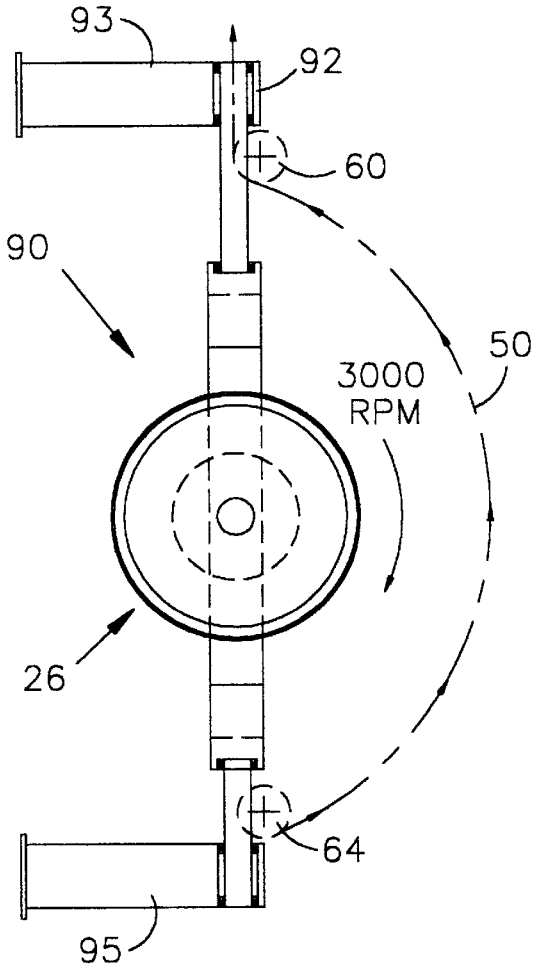
FIG. 13 is a side elevational view of the alternate embodiment shown in FIG. 12.
Figure 12:
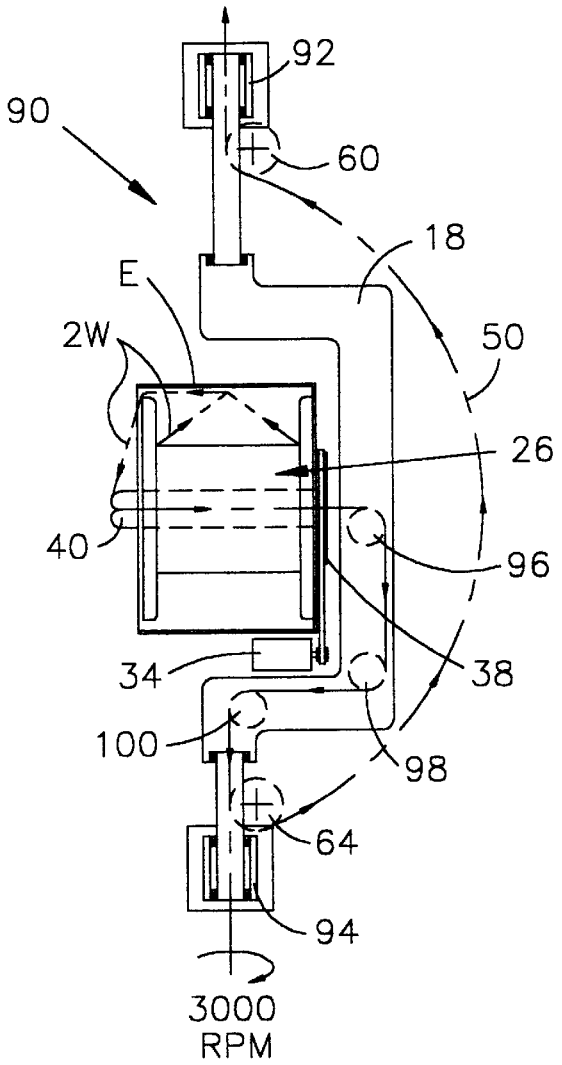
FIG. 12 is a top plan view of an alternate embodiment of the invention utilizing a single bobbin from which two wires are simultaneously removed and twisted by the apparatus.

While the embodiment shown in FIGS. 12 and 13 is in certain respects similar to the apparatus disclosed in U.S. Pat. Nos. 5,400,579 and 5,622,039, it differs from the previous apparatus in that the wires on the bobbin in FIGS. 12 and 13 are twisted as they are flown off. Therefore, in the prior art machines, the total twist rate is a function of only the rotational speed of the bows, while in the instant invention the twist rate is also a function of the speed of rotation of the bobbin imparted by the motor 34.

While a bobbin or reel drive is disclosed in U.S. Pat. No. 5,400,579 as being used with a double twist machine, the drive is disclosed as being optional in order to make the machine more versatile. The primary purpose of the reel drive in the aforementioned patent is to permit smaller wires to be twinned without placing excessive stresses on the wires or stretching the same. The drive is described as being an alternative to a fly-off or take-off arm of the type that rotates about the reel and flies off the wires off the reel. However, in this patent the wire is drawn off longitudinally and is not flown off across one of the rims or flanges of the bobbin and ultimately redirected through the hub or drum thereof in order to impart a twist associated with such fly-off In the instant application, the motor rotates the bobbin at an appropriate speed and the wire is flown off the flange or rim in order to impart a twist to the wire.

As in the machines described in the aforementioned patents, it will be clear to those skilled in the art that the apparatus shown in FIGS. 12 and 13 can be modified to suit any specific application. Thus, the machine can be readily adapted to make "triplets" or "quads", by including an appropriate number of bobbins within the bow and by pre-winding an appropriate number of wire conductors on selected bobbins. Thus, each of the bobbins can be initially wound with one, two, three or four wires which can be dispensed in the manner described. When two or more wire conductors are pre-wound on a single bobbin and simultaneously flown off the bobbin, the conductor wires so pre-wound are initially twisted about each other as they fly off the bobbin. After all of the conductor wires are flown off their respective bobbins, all the wire conductors, whether individually or twisted in various combination, are all again twisted about each other as they pass through the pulleys associated with the bow 50.

It is possible to modify the embodiment shown in FIGS. 12 and 13 by enlarging the cradle 50 to receive two or more bobbins or reels each of which are rotatably mounted on a cradle. The number of bobbins and the number of wires on each bobbin will, of course, be a function of the ultimate cable that needs to be produced. It is important, however, that there be at least one bobbin wound with a total of at least two insulated wires. Those two wires can come from two different bobbins or from a single bobbin. Beyond that, any desired arrangement may be used to fit a particular purpose or application. Thus, for example, if two bobbins are mounted in the cradle with two wires on each bobbin, the machine can operate as a quadding machine.

Thus, it should be clear that a single twisting head may be used for the production of the simplest twisted wire pair conductors or numerous twisting units may be used, one for each twisted wire configuration to be included in a composite cable. Furthermore, as suggested, in the production of the simplest twisted pairs, each of the bobbins may issue a single wire element or conductor. However, other numerous approaches may be taken. It is only important that the cradle be dimensioned to receive a few as a single reel wound with a total of at least two separate or connected wires which can be simultaneously unwound. Thus, if a twinned wire triad is to be formed, this can be achieved with either three bobbins each issuing one single wire or conductor, two reels, one of which issues a single wire or conductor and the other issues two separate or connected wire or conductors, or even a single reel, which issues three separate or connected wires or conductors. The formation of a twisted wire quad can likewise be formed in a number of different ways, such as two separate or connected wires issuing from each of two reels, one of which issues a single wire or conductor and the other issues three separate or connected wires or conductors; or four reels, each issuing a single wire conductor.

The invention has been shown and described by way of a presently preferred embodiment, and many variations and modifications may be made therein without departing from the spirit of the invention. The invention, therefore, is not to be limited to any specified form or embodiment, except insofar as such limitations are expressly set forth in the claims.

What I claim:

1. Apparatus for manufacturing communication cables, comprising at least one "inside-out" rigid twist machine; support means for rotatably supporting at least one bobbin wound with a total of at least two insulated conductor wires, within each of said at least one twisting machine to substantially fix the positions and orientations of said at least one bobbin, each of said rigid twisting machines including first drive means for spinning each of said at least one bobbin about their respective axes; fly-off means for flying off said at least two insulated conductor wires wound on said at least one bobbin with substantially no tension in the wires when said at least one bobbin attains a first rotational speed; guide means for guiding the wires from said at least one said bobbin to a closing point; closing means for closing the wires; twisting means including second drive means for twisting the closed wires at a second rotational speed to form a twinned cable; control means for adjusting said first and second rotational speeds and for imparting a twist rate to said conductor wires which is a function of the composite of said first and second rotational speeds; and take-up means for taking up the twinned cable.

2. Apparatus as defined in claim 1, wherein one bobbin wound with a pair of insulated conductors is supported within each twisting machine to produce a paired cable.

3. Apparatus as defined in claim 1, wherein a plurality of like twisting machines are arranged in a bank or line of machines each for forming a twinned cable; and further comprising a further twisting means for assembling the twinned cables into a multi-cable assembly.

4. Apparatus as defined in claim 3, wherein said further twisting machine comprises a double twist machine.

5. Apparatus as defined in claim 1, wherein said rigid twist machine includes a stationary frame and said support means comprises at least one cradle supported by bearings mounted on said frame for supporting said at least one bobbin; and magnetic means provided on said cradle means and on said frame for substantially fixing said at least one cradle in relation to said stationary frame notwithstanding the rotation of said twisting means.

6. Apparatus as defined in claim 1, wherein said guide means includes friction minimizing means for minimizing friction as each wire flies off an associated bobbin over the flange thereof.

7. Apparatus as defined in claim 6, wherein said friction minimizing means comprises a plate generally coextensive with a flange of each bobbin on which fly-off is to take place, said plate including a generally rounded rim which covers the periphery of the flange.

8. Apparatus as defined in claim 6, wherein said friction minimizing means comprises a smooth surfaced disc proximate to each flange over which fly off is to take place, whereby the torsioned wires can be guided by said guide means without engaging said flange.

9. Apparatus as defined in claim 1, wherein said guide means includes guide sheaves for bringing the wires within each twisting machine into proximity to each other prior to twinning by said twisting means.

10. Apparatus as defined in claim 1, further comprising tension inducing means for controlling in the wires being paid off.

11. Apparatus as defined in claim 10, wherein said tension inducing means comprises an enclosure for at least partially enclosing each bobbin and provided with a friction generating surface facing the bobbin, whereby an excessively large loop formed during fly-off causes the torsioned wire to contact said friction generating surface and thereby increase the tension in the wire.

12. Apparatus as defined in claim 11, wherein said friction generating surface comprises a carpeted surface.

13. Apparatus as defined in claim 1, wherein said first drive means comprises a separate motor for driving each bobbin.

14. Apparatus as defined in claim 1, wherein said first drive means comprises a single motor and drive belt for driving said at least one bobbin within each rigid twisting machine at the same speed.

15. Apparatus as defined in claim 1 for manufacturing communication cables with improved, more uniform impedance characteristics at signal frequencies up to 600 MHz, wherein said support means rotatably supports at least two bobbins each wound with an insulated conductor wire within each of said at least one twisting machine, said first drive means being arranged for spinning each of said at least two bobbins about their respective axes and flying off an insulated conductor wire wound on each of said at least two bobbins with substantially no tension in the wire when the bobbin attains a first rotational speed, said guide means guiding the wires from each of said at least two bobbins to a closing point, and said control means being adjusted to set said first and second rotational speeds to apply a pre-twist to each of the wires about their individual neutral axes prior to twinning.

16. Apparatus as defined in claim 15, wherein two bobbins are supported within each twisting machine to produce a paired cable.

17. Apparatus as defined in claim 15, wherein said first drive means comprises a single motor and drive belt for driving all bobbins within each rigid twisting machine at the same speed.

18. A method of manufacturing cables, comprising the steps of supporting at least one bobbin wound with a total of at least two insulated conductor wires, within each of at least one rigid twisting machine; spinning said at least one bobbin about their respective axes; flying off said at least two insulated conductor wires wound on said at least one bobbin with substantially no tension in the wires when said at least one bobbin attains a first rotational speed of rotation; guiding the wires from said at least one bobbin to a closing point; closing the wires; twisting the closed wires at a second rotational speed to form a twinned cable; adjusting said first and second rotational speeds and imparting a twist rate to said conductor wires which is a function of the composite of said first and second rotational speeds; and taking up the twinned cable downstream of said at least one rigid twisting machine.

19. A method as defined in claim 18, wherein the step of flying off comprises pulling off a pair of wires from a bobbin over one of the flanges of the bobbin.

20. A method as defined in claim 18, further comprising the step of adjusting the tension on each wire prior to twinning.

21. A method as defined in claim 18, further comprising group twinning the cables emanating from a plurality of rigid twisting rigid machines to form a multi-cable assembly.

22. A method of manufacturing cables with improved, more uniform impedance characteristics at signal frequencies up to and above 600 MHz, as defined in claim 15, wherein at least two bobbins are supported within each of at least one rigid twisting machine, an insulated conductor wire wound on each bobbin flying off the bobbin with substantially no tension in the wire when the bobbin attains a first rotational speed of rotation, said first and second rotational speeds being adjusted to apply a pre-twist to each of the wires about their individual neutral axes prior to twinning; and taking up the twinned cable downstream of the rigid twisting machine.

23. A method as define in claim 22, wherein said step of pre-twisting comprises the step of providing a backtwist within range of 5%–/100%.

* * * * *